US008402954B2

(12) United States Patent
Matsuda et al.

(10) Patent No.: US 8,402,954 B2
(45) Date of Patent: Mar. 26, 2013

(54) IGNITION DEVICE FOR INTERNAL COMBUSTION ENGINE

(75) Inventors: Kenji Matsuda, Kariya (JP); Yasuo Kakumae, Anjo (JP)

(73) Assignee: Denso Corporation, Kariya (JP)

( * ) Notice: Subject to any disclaimer, the term of this patent is extended or adjusted under 35 U.S.C. 154(b) by 451 days.

(21) Appl. No.: 12/662,202

(22) Filed: Apr. 6, 2010

(65) Prior Publication Data

US 2010/0263644 A1 Oct. 21, 2010

(30) Foreign Application Priority Data

Apr. 15, 2009 (JP) ..... 2009-98959
Dec. 11, 2009 (JP) ..... 2009-281552

(51) Int. Cl.
*F02P 11/00* (2006.01)
*F02P 11/02* (2006.01)

(52) U.S. Cl. ..... 123/630; 123/143 B

(58) Field of Classification Search ..... 123/625, 123/626, 630, 143 R, 143 B
See application file for complete search history.

(56) References Cited

U.S. PATENT DOCUMENTS 5,571,245 A 11/1996 Ooyabu
5,664,550 A * 9/1997 Ito et al. ..... 123/630
5,819,713 A * 10/1998 Kesler ..... 123/630
6,539,929 B2 * 4/2003 Ito et al. ..... 123/630
2004/0011342 A1 1/2004 Fukatsu
2009/0139505 A1 * 6/2009 Naito et al. ..... 123/644

FOREIGN PATENT DOCUMENTS

JP A-2000-240549 9/2000
JP A-2004-197730 7/2004
JP A-2008-045514 2/2008

OTHER PUBLICATIONS

JP 64045963 (Noboru et al. ) Feb. 20, 1989 (abstract). [online] [retrieved on Aug. 24, 2012]. Retrieved from: JPO Database.*

Office Action mailed on May 10, 2011 issued from the Japanese Patent Office in the corresponding Japanese patent application No. 2009-281552 (English translation enclosed).

* cited by examiner

*Primary Examiner* — Mahmoud Gimie
(74) *Attorney, Agent, or Firm* — Posz Law Group, PLC

(57) ABSTRACT

When an ECU applies to an igniter a plurality of pulse signals, the duty ratio of which is lower than a predetermined duty ratio, as a lock release signal, a latch circuit of a lock inhibition circuit stops applying a shut-off signal to a shut-off circuit thereby to release a lock condition of an IGBT. A drive main circuit thus restarts current supply to the IGBT. A condition detection circuit outputs to the ECU a condition signal corresponding to the current supplied while the IGBT is turned on.

8 Claims, 18 Drawing Sheets

IGNITION DEVICE FOR INTERNAL COMBUSTION ENGINE

CROSS REFERENCE TO RELATED APPLICATION

This application is based on and incorporates herein by reference Japanese Patent Applications No. 2009-98959 field on Apr. 15, 2009 and No. 2009-281552 filed on Dec. 11, 2009.

FIELD OF THE INVENTION

The present invention relates to an ignition device for an internal combustion engine, which controls current supply to an ignition coil in response to an ignition signal produced from an electronic control unit and supplies an ignition condition signal back to the electronic control unit thereby indicating a condition of the current supply to the ignition coil.

BACKGROUND OF THE INVENTION

An ignition device for an internal combustion engine receives an ignition signal by an igniter circuit block from an electronic control unit (ECU) and supplies an ignition condition signal (for example, failure signal) from the igniter circuit block thereby responding to the ECU (for example, patent document 1). Further, similar technologies are disclosed in patent documents 2 and 3.

(Patent document 1) JP 8-128381A (U.S. Pat. No. 5,571,245)
(Patent document 2) JP 2004-36438A (US 2004/0011342)
(Patent document 3) JP 2004-197730A One such a circuit example is shown in FIG. 17. As shown in FIG. 17, an ignition device 101 for an internal combustion engine (not shown) is provided with an igniter 102, an ignition coil 3 and a diode 4 connected in the shown configuration and energizes the ignition coil 3 in response to an ignition signal IGt supplied from an ECU 5 for activating a spark plug 6.

In the igniter 102, a switching element such as an IGBT and a temperature detection diode (not shown) for detecting the temperature inside the IGBT are provided. The gate drive of the IGBT is shut off, when it is determined based on the voltage-temperature characteristic of the temperature detection diode that the IGBT is in the over-temperature condition. This gate drive shut-off function is referred to as a lock inhibition function. With this lock inhibition function, the temperature of the IGBT is decreased to protect the IGBT from over-temperature breakdown.

FIG. 18A shows an example of detection of the temperature inside the igniter and the lock inhibition function, and FIG. 18B shows in a time chart form a basic operation of the lock inhibition function and inhibition release processing.

As shown in FIG. 18A, the igniter 102 is provided with a temperature detection circuit 114 and a latch circuit 115. In the normal operation, the temperature detection circuit 114 detects the temperature of the IGBT. Since the temperature detection circuit 114 detects that the temperature of the IGBT is low in the normal operation, a normal drive signal voltage VG is applied to the gate of the IGBT in response to the ignition signal IGt (time t0 in FIG. 18B). When the temperature detection circuit 114 detects that the temperature of the IGBT rises to be higher than a predetermined temperature (that is, the voltage Vf of the built-in diode in the IGBT falls to be lower than an over-temperature reference Vref), a set signal is applied to the set terminal S of the latch circuit 115.

The latch circuit 115 produces a lock output Lck to shut off the gate drive signal (time t1 in FIG. 18B), when the set signal is applied from the temperature detection circuit 114. The lock output Lck indicates that the current supply to the IGBT is too much. Thus, the IGBT is protected from breakdown by shutting off supply of a current I1, which flows in the IGBT.

Since a power-off command signal is applied to the reset terminal R of the latch circuit 115 as shown in FIG. 18A, the lock condition is released when power supply of a battery +B is turned off as shown in FIG. 18B (time t2).

However, once the igniter 102 has become abnormal and locked, it is only possible to release the lock by turning off the power supply. It is not convenient to release the lock of the igniter 102 by the ECU 5. For example, the power supply must be turned of to restart the internal combustion engine, each time the igniter 102 is locked by an abnormality signal produced temporarily at time of engine starting or the like.

SUMMARY OF THE INVENTION

It is therefore an object of the present invention to provide an ignition device for an internal combustion engine, which allows readily release an igniter from a lock condition.

According to one aspect of the present invention, an ignition device for an internal combustion engine includes a switching element connected to an ignition coil, a drive section configured to turn on and off current supply to the ignition coil by turning on and off the switching element in response to an ignition signal supplied from the electronic control unit, a temperature detection section configured to detect temperature of the switching element, a shut-off section configured to shut off the current supply to the switching element when the temperature detected by the temperature detection section rises to be higher than a predetermined temperature, a timer section configured to measure a predetermined time interval after the current supply is shut off by the shut-off section, and a release section configured to release a current supply shut-off condition of the switching element when measurement of the predetermined time interval by the timer section is completed.

According to another aspect of the present invention, the release section is modified to release a current supply shut-off condition of the switching element in response to a release signal supplied from the electronic control unit.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

First Embodiment

Figure 1:
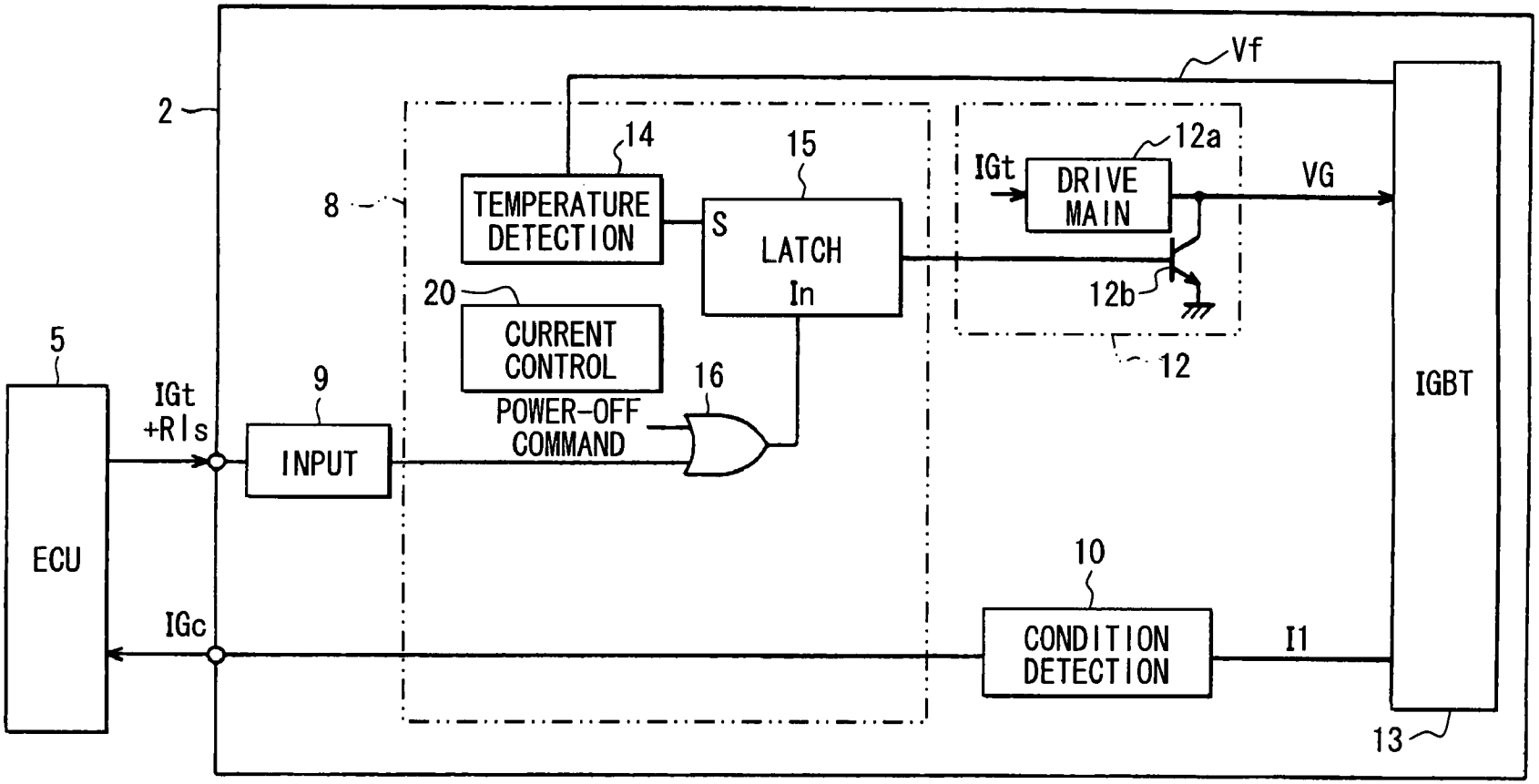
FIG. 1 is a block diagram showing a first embodiment of the present invention.

The first embodiment of the present invention will be described with reference FIGS. 1 to 7, in which an ignition device for an internal combustion engine is shown generally in a block diagram and denoted by a reference numeral 1.

Figure 2:
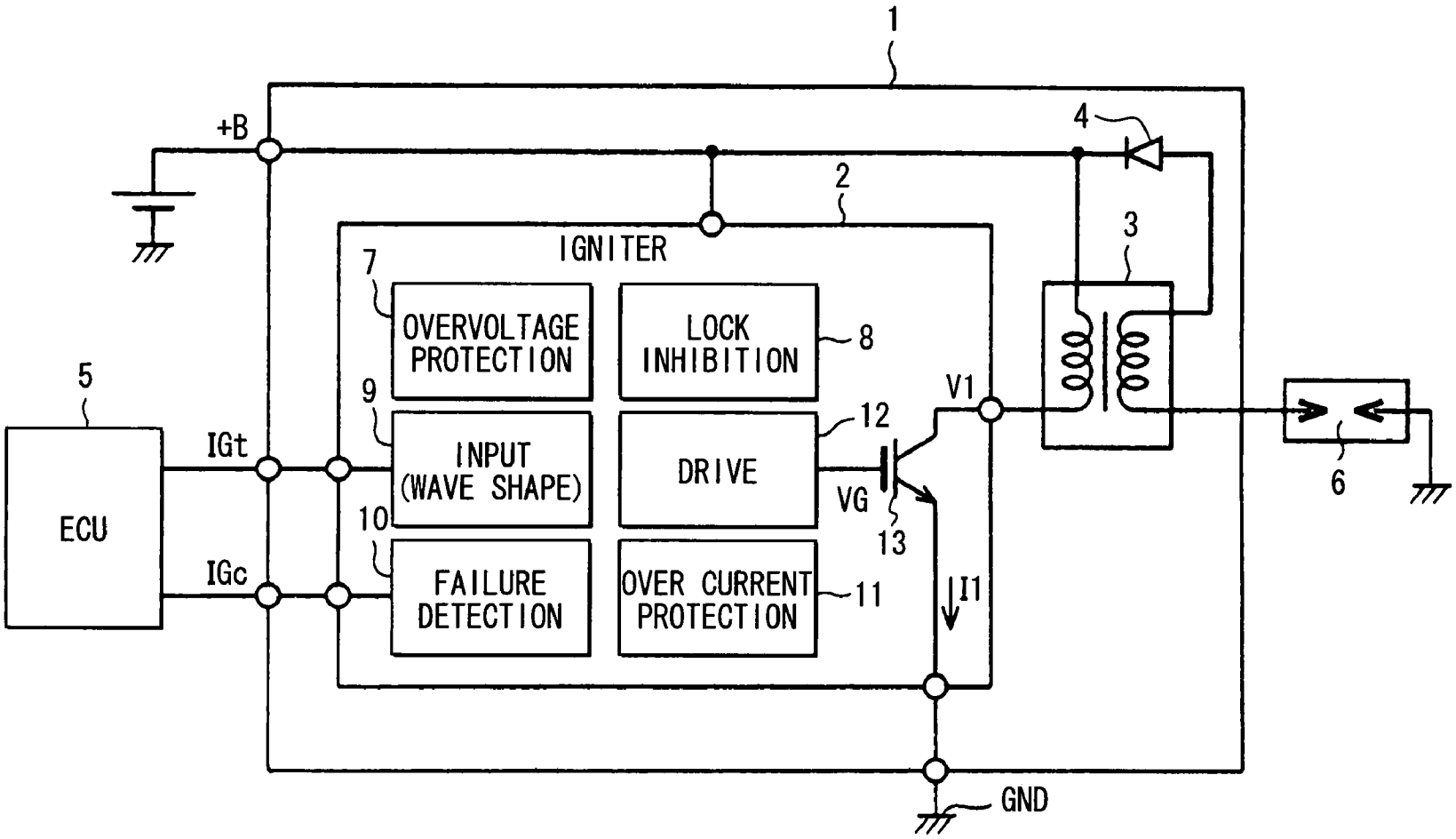
FIG. 2 is a block diagram schematically showing an ignition device for an internal combustion engine in the first embodiment.

As shown in FIG. 2, the ignition device 1 is provided with an igniter 2, an ignition coil 3, a diode 4 and the like to operate with a power supply voltage of a battery +B. The ignition device 1 is configured to activate a spark plug 6 through the ignition coil 3 in response to an ignition signal IGt produced from an electronic control unit (ECU) 5 so that fuel may be ignited by ignition spark generated by the spark plug 6.

The igniter 2 is mainly provided with an over-voltage inhibition circuit 7, a lock inhibition circuit 8, an input circuit (waveform shape circuit) 9, a condition detection circuit 10, an over-current protection circuit 11 and a drive circuit 12. An insulated gate bipolar transistor (IGBT) 13 is connected as a drive transistor to the drive circuit 12. The igniter 2 is thus configured with a semiconductor integrated circuit and the IGBT 13.

The primary winding of the ignition coil 3 and the IGBT 13 are connected in series between the battery +B and the ground GND. The IGBT 13 is provided to control current supply (energization) time of a primary current of the ignition coil 3. The diode 4, which is in reverse-biased configuration, and the secondary winding of the ignition coil 3 and the spark plug 6 are connected in series between the battery +B and the ground GND.

The internal circuit configuration of the ignition device 1 is shown in FIG. 1. As shown in FIG. 1, an electronic control unit (ECU) 5 is connected to output an ignition signal IGt and a release signal Rls to the igniter 2. The ignition signal IGt produced from the ECU 5 is inputted to the input circuit 9. The input circuit 9 shapes the waveform of the ignition signal IGt and outputs it to the lock inhibition circuit 8. The lock inhibition circuit 8 outputs a shut-off signal to a shut-off circuit 12*b* of the drive circuit 12 in response to the ignition signal IGt and a temperature detection signal indicative of the temperature of the IGBT 13.

The drive circuit 12 is configured with a drive main circuit 12*a* as a drive section and the shut-off circuit 12*b* connected to the drive main circuit 12*a*. In the normal condition, the drive main circuit 12*a* drives the IGBT 13. When the shut-off signal is applied to the shut-off circuit 12*b* during this normal drive operation, the shut-off circuit 12*b* shuts off drive of the IGBT 13 performed by the drive main circuit 12*a* by turning on the shut-off circuit 12*b* thereby to short-circuit the gate drive voltage VG.

The lock inhibition circuit 8 is provided with a temperature detection circuit 14 as a temperature detection section, a latch circuit 15 for effecting and releasing a lock condition and an OR gate 16. The temperature detection circuit 14 detects a temperature based on a voltage Vf of a diode (diodes) D1 (FIG. 3) provided in the IGBT 13.

Figure 3:
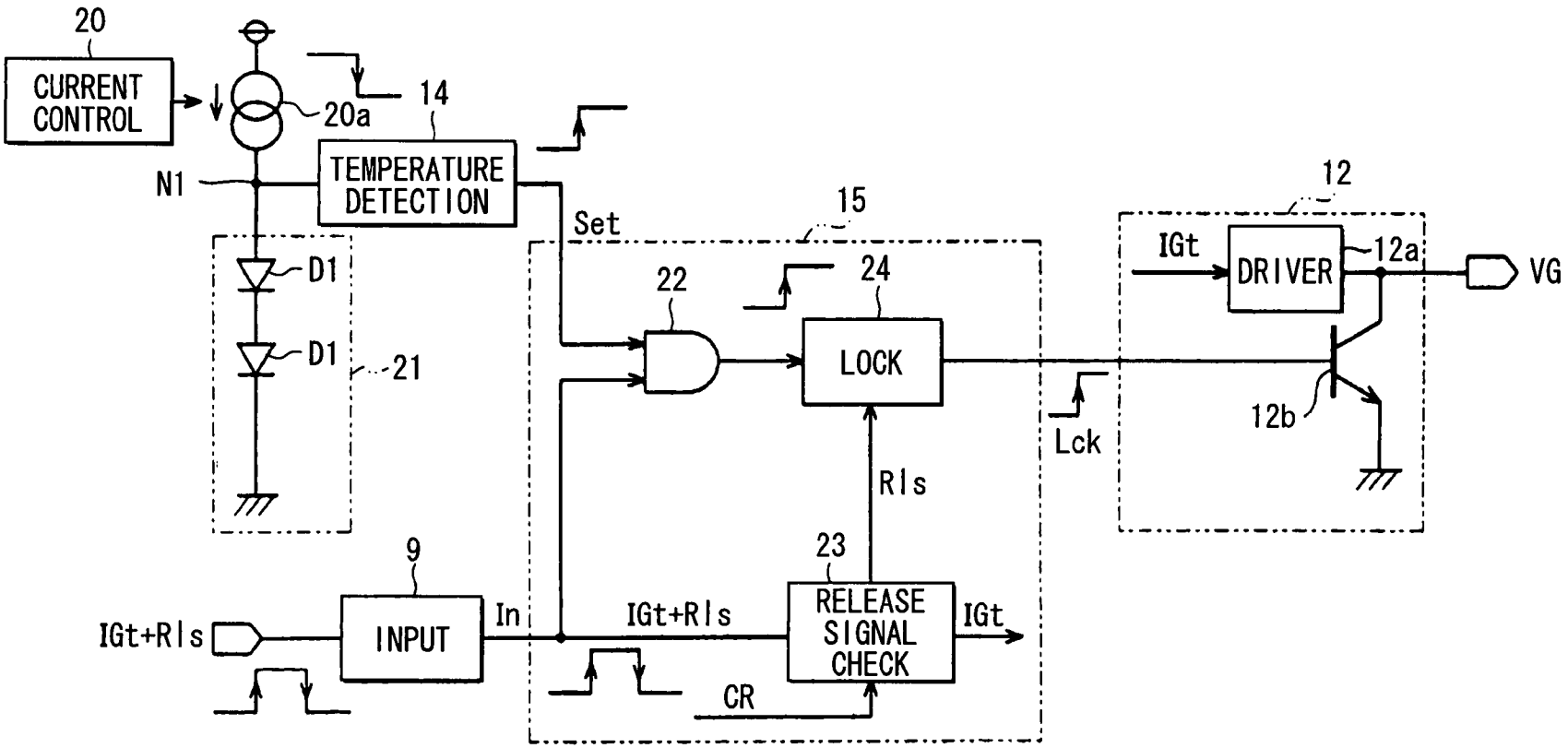
FIG. 3 is a circuit diagram schematically showing a lock inhibition circuit and its peripheral circuits in the first embodiment.

One example of electrical connection between the temperature detection circuit 14 and the diode D1, which is built in the IGBT is shown in FIG. 3. As shown in FIG. 3, a current source 20*a* and a diode group 21 of a plurality of diodes D1 are connected in series between the power source and the ground. The common junction N1 between the current source 20*a* and the diode group 21 is connected to the temperature detection circuit 14. A current control circuit 20 is provided to control the current source 20*a* so that the current source 20 supplies either a first current or a second current, which is lower than the first current. The current source 20*a* is configured to supply a constant first current in the normal condition. The voltage Vf of the diode V1 decreases as the temperature of the diode D1 rises.

The temperature detection circuit 14 is configured to detect the temperature change by detecting a voltage change at the common junction N1 corresponding to the Vf change of the diode D1. The current control circuit 20 controls the current value of the current source 20*a* to decrease from the first current to the second current when the voltage at the common junction N1 falls to be lower than the predetermined voltage. The current control circuit 20 controls the current value of the current source 20*a* to increase from the second current to the first current when the voltage at the common junction N1 rises to be higher than a predetermined threshold reference Vref.

As shown in FIG. 1, a temperature detection signal of the temperature detection circuit 14 is inputted to the set terminal S of the latch circuit 15. The temperature detection circuit 14 determines that the temperature of the IGBT 13 is higher than the predetermined temperature (over-temperature) and outputs a set signal of H-level (high voltage level) to the set terminal S of the latch circuit 15, when the voltage Vf at the common junction N1 decreases to be lower than the predetermined reference voltage Vref (over-temperature reference level). The predetermined temperature may be set as follows. The predetermined temperature is set to 175 to 195° C. based on a limit of a withstand-temperature of the IGBT 13.

The output signal of the input circuit 9 is applied to an OR gate 16. A power-off command signal is inputted to the OR gate 16, and an output signal of the OR gate 16 is inputted to an input terminal In of the latch circuit 15. The ignition signal IGt therefore is inputted to the input terminal In of the latch circuit 15 through the input circuit 9, unless the power-off command signal is applied to the OR gate 16.

The output of the latch circuit 15 is applied to the shut-off circuit 12*b* of the drive circuit 12. When the output of the latch circuit 15 becomes H-level, the interrupt circuit 12*b* connects the output of the drive main circuit 12*a* to the ground thereby to the ground and shut off the gate output applied to the IGBT 13. Thus the current flowing in the IGBT 13 is interrupted.

Figure 13:
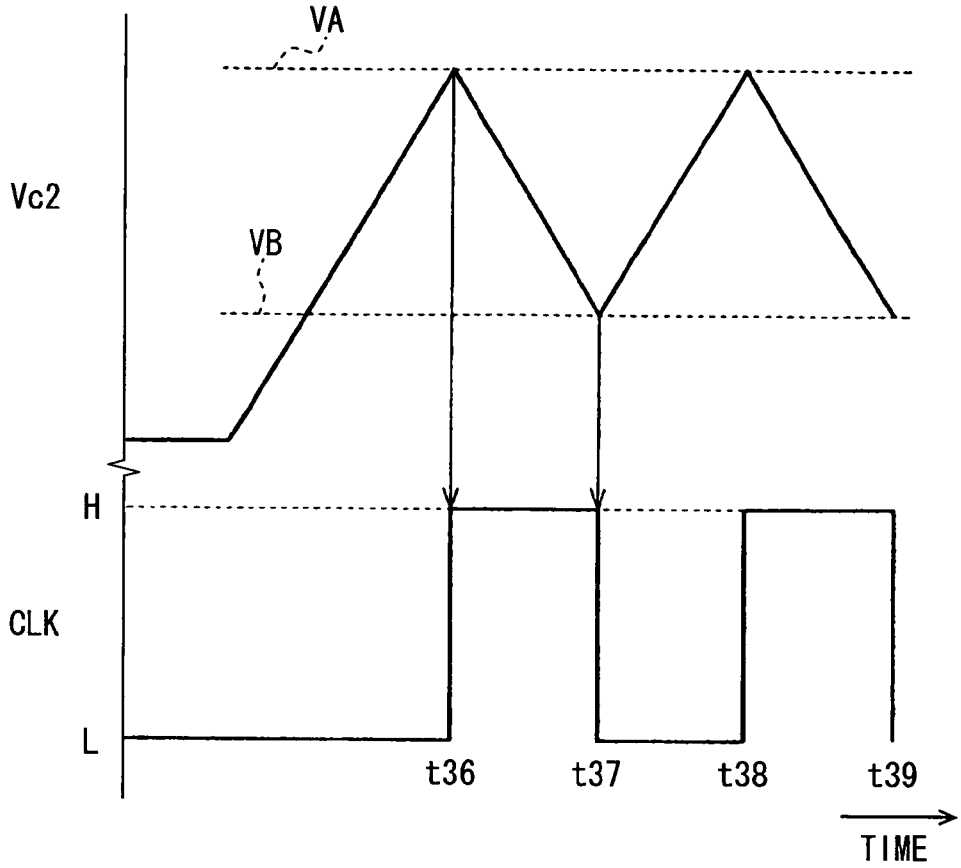
FIG. 13 is a time chart schematically showing signal waveforms in the third embodiment.

The latch circuit 15 is shown in FIG. 3 in detail. As shown in FIG. 13, the latch circuit 15 is configured with an AND gate 22. The output of the temperature detection circuit 14 and the output of the input circuit 9 are inputted to the AND gate 22. The output of the input circuit 9 is also applied to the input of a release signal check circuit 23.

The release signal check circuit 23 checks and selects the pulse-shaped release signal Rls superimposed on the ignition signal IGt and applies it to the lock circuit 24. The release signal check circuit 23 is formed of a filter circuit, which passes the pulse-shaped release signal Rls. The output of the AND gate 22 is also applied to the lock circuit 24.

The lock circuit 24 shuts off the current supplied to the IGBT 13 by applying a H-level signal to the drive circuit 12 so that the shut-off circuit 12*b* is turned on, when the output of the AND gate is applied to the lock circuit 24. The lock circuit 24 also releases the current shut-off condition of the IGBT 13 by applying a L-level signal to the drive circuit 12 so that the shut-off circuit 12*b* is turned off, when the release signal Rls is applied from the release signal check circuit 23.

Figure 4:
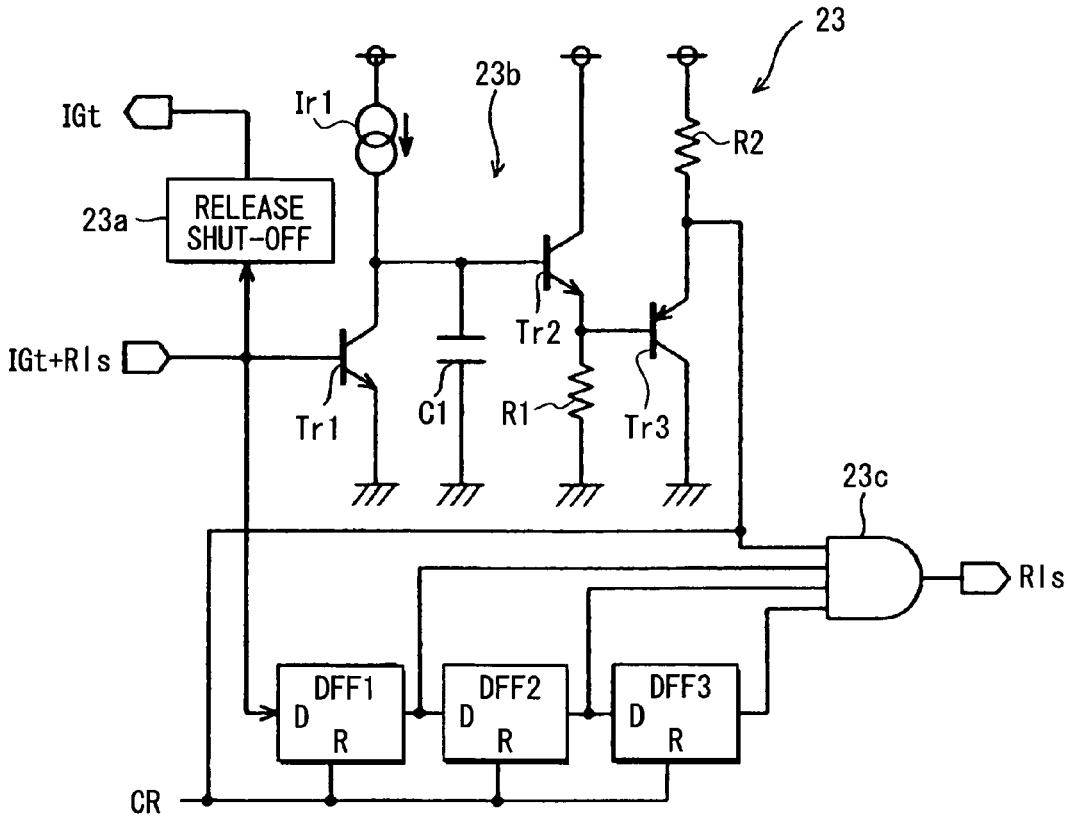
FIG. 4 is a circuit diagram showing in detail a release signal check circuit in the first embodiment.

The release signal check circuit 23*a* is shown in detail in FIG. 4. As shown in FIG. 4, the output of the input circuit 9 is connected to a release signal shut-off circuit 23*a*. The release signal shut-off circuit 23*a* is configured to pass only the ignition signal IGt and output the ignition signal IGt to the drive main circuit 12*a*, when the ignition signal IGt with the release signal Rls is inputted from the input circuit 9.

A charge/discharge circuit 23*b* is connected to the input circuit 9. The charge/discharge circuit 23*b* is formed of a current source Ir1, NPN transistors Tr1, Tr2, a PNP transistor Tr3, a capacitor C1, resistors R1, R2 and the like. The base of the transistor Tr1 is connected to the output of the input circuit 9. The current source In supplies its current to the collector of the transistor Tr1. The emitter of the transistor Tr1 is connected to the ground.

The common junction between the collector of the transistor Tr1 and the current source Ir1 is connected to a charge/discharge terminal of the capacitor C1. The charge/discharge terminal of the capacitor C1 is connected to the base of the transistor Tr2. The collector of the transistor tr2 is connected to the power source. The emitter of the transistor Tr2 is connected to the ground through the resistor R1.

Both end terminals of the resistor R1 is connected to the base and the collector of the transistor Tr3. The emitter of the transistor Tr3 is connected to the power source through the resistor R2. The common junction between the resistor R2 and the transistor Tr3 is inputted to an AND circuit 23*c* as a digital output.

D-type flip-flops DFF1 to DFF3 are connected in cascade to form a shift register. The D-input of the flip-flop DFF1 is connected to the output of the input circuit 9. A counter reset signal CR is provided as a voltage signal at a common junction between the emitter of the transistor Tr3 and the resistor R2 and connected to the reset terminals R of the flip-flops DFF1 to DFF3. The AND circuit 23*c* outputs the release signal Rls at its output.

Figure 5:
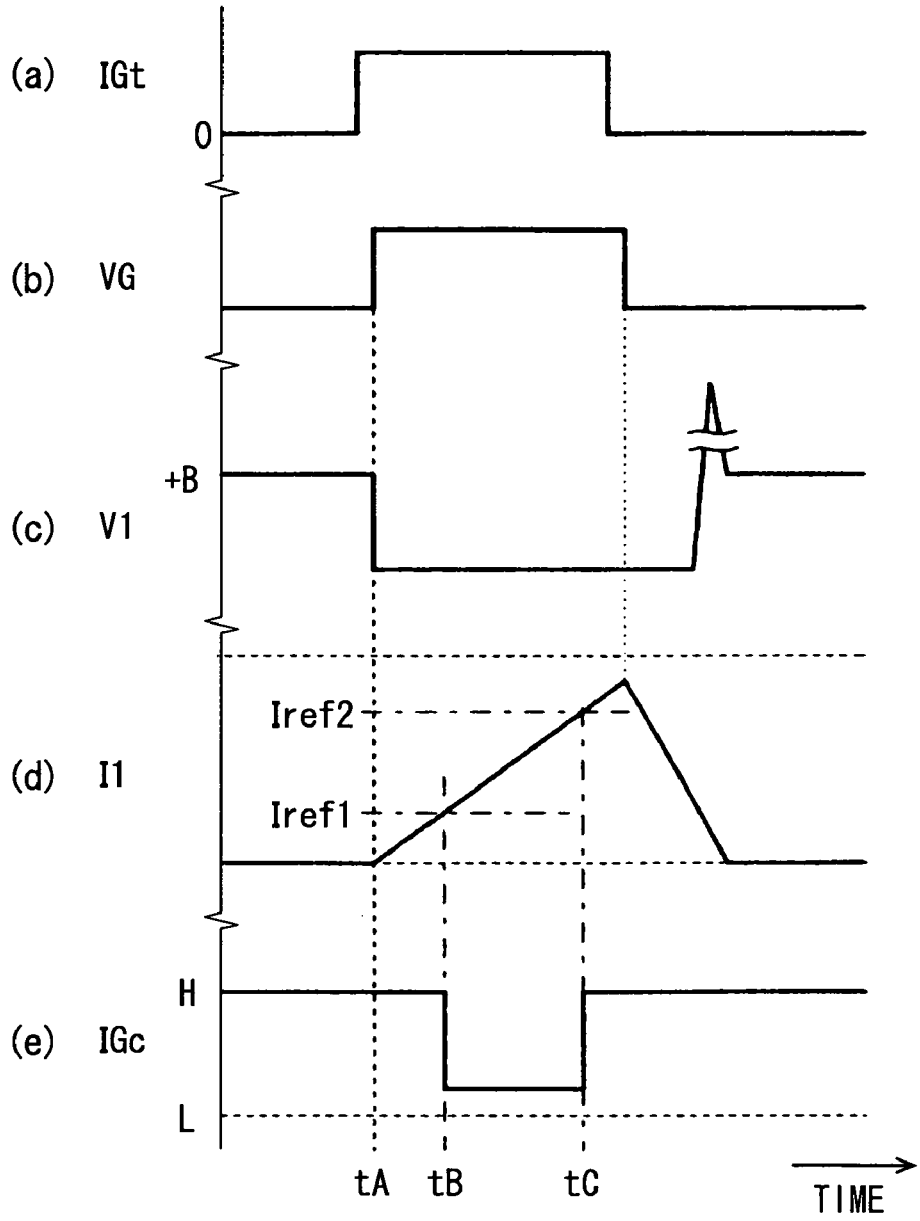
FIG. 5 is a time chart showing a basic operation of an igniter in the first embodiment.

The igniter 2 generally operates as schematically shown in FIG. 5. As shown in FIG. 5, when the ECU 5 produces the ignition signal IGt to the igniter 2, the gate voltage VG of the IGBT 13 rises and the IGBT 13 turns on to start supply of an energization current I1 to the primary winding of the ignition coil 3 through the collector-emitter path of the IGBT 13 (time tA). The energization current I1 increases gradually. At this moment, the collector voltage V1 of the IGBT V1 falls instantly. The energization current I1 rises gradually in proportion to elapse of time.

The energization current I1, which flows in the collector-emitter path of the IGBT 13, gradually increases as time passes and reaches a first reference current Iref1 (time tB). A condition signal IGc produced by the condition detection circuit 10, is reversed, for example, from H-level to L-level. When the energization current I1 further increases in proportion to elapse of time from the first reference current Iref1 and reaches a second reference current Iref2, the condition signal IGc is reversed, for example, from the L-level to the H-level (time tC). The condition detection circuit 10 thus, also operates as a failure detection circuit, because the ECU 5 can recognize failure (for example, shut-off of the IGBT 13) if the condition signal IGc does not change its level for a long period (time t12 to t14 in FIG. 6), as described below with reference to FIG. 6.

By operating as described above, the igniter 2 thus supplies the condition signal IGc back to the ECU 5 when the energization current I1 flows. The condition signal IGc is in the pulse form and indicates an ignition condition signal of the spark plug 6. The ECU 5 can thus detect the energization condition of the IGBT 13 and the ignition condition of the spark plug 6 based on the condition signal IGc at each ignition event.

Figure 6:
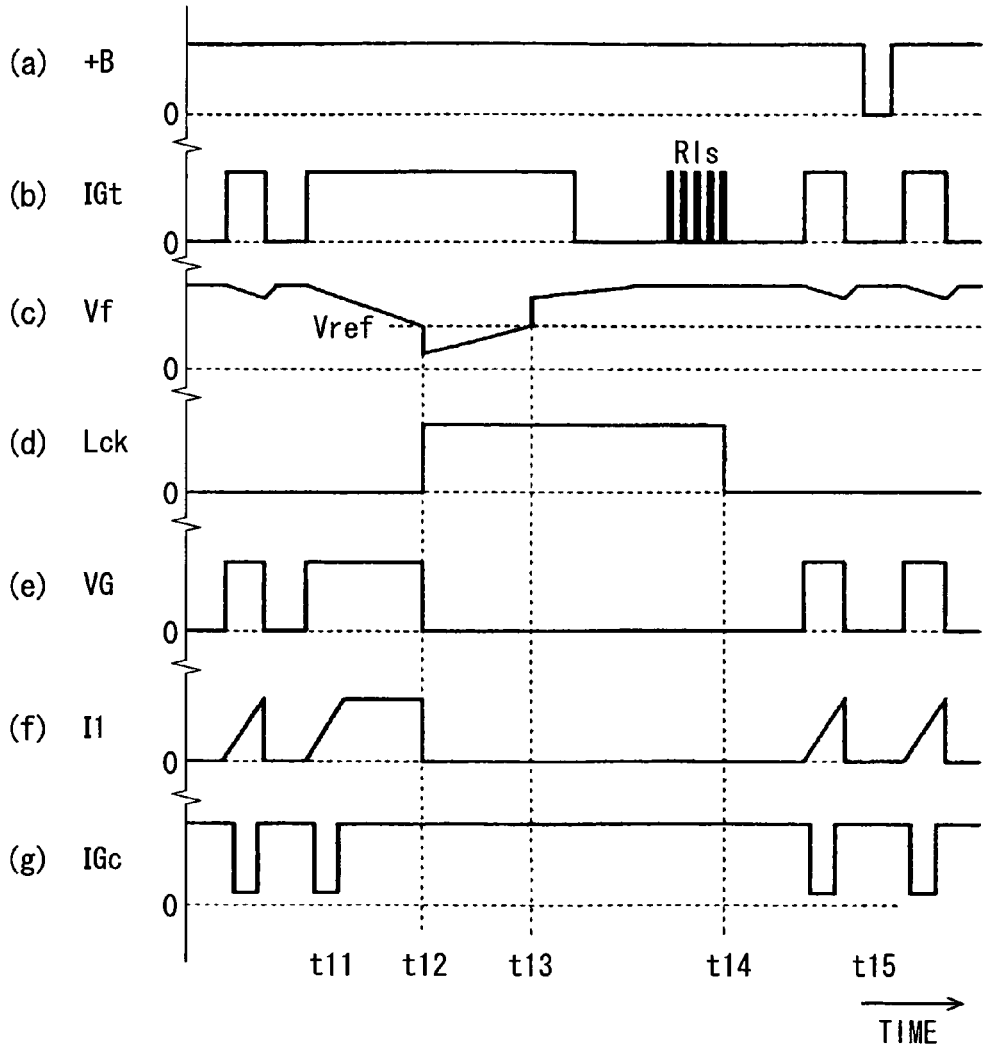
FIG. 6 is a time chart showing changes of various signals in the first embodiment.

The operation of the first embodiment is shown in FIG. 6. As shown in FIG. 6, under a condition that the battery power +B is supplied to the igniter 2, the ECU 5 produces the ignition signal IGt of a predetermined duty ratio. This ignition signal IGt is applied to the gate of the IGBT 13 through the OR gate 16, the latch circuit 15 and the drive circuit 12 shown in FIG. 1. The IGBT 13 normally drives the ignition coil 3 in response to the ignition signal IGt. If the energization current I1 continues to flow in the IGBT 13 in driving the ignition coil 3, the temperature of the IGBT 13 rises.

The temperature detection circuit 14 detects the decrease of the voltage Vf of the built-in diode group 21 based on the voltage Vf developed at the common junction N1. The temperature detection circuit 14 determines that the temperature of the IGBT 13 has increased to be higher than the predetermined over-temperature when the voltage Vf decreases to be lower than the predetermined reference voltage Vref, which corresponds to the predetermined over-temperature.

As shown in FIG. 6, the voltage Vf of the built-in diode group 21 decreases as the temperature of the IGBT 13 increases during a period including time t11.

For example, if the duty ratio of the ignition signal IGt is large and the H-level period of the ignition signal IGt becomes lengthy, the temperature of the IGBT 13 gradually rises and the voltage Vf of the diode group 21 decreases to be lower than the predetermined reference Vref at time t12.

The AND gate 22 of the latch circuit 15 outputs the H-level signal and the lock circuit 24 produces the H-level lock signal Lck to the shut-off circuit 12*b*. With this lock signal Lck, the gate voltage VG is not applied to the IGBT 13 because it is grounded by the shut-off circuit 12*b*. This is a shut-off condition of energization current supply. In the lock condition, no current flows in the IGBT 13. As a result, the temperature of the IGBT 13 gradually falls and the voltage of the diode group 21 increases. The voltage at the common junction N1 correspondingly rises.

The temperature detection circuit 14 maintains its L-level output signal after the voltage at the common junction N1 reaches the reference voltage Vref. Although this L-level output signal is applied to the AND gate 22, no release signal Rls is applied to the lock circuit 24 at this moment. Therefore, the lock condition is not released. This is because the lock circuit 24 maintains its output fixed.

When the release signal Rls of a plurality of pulse signals is superimposed on the ignition signal IGt and applied to the latch circuit 15, the release signal check circuit 23 detects the plurality of pulse signals superimposed as the release signal Rls on the ignition signal IGt and outputs the release signal to the lock circuit 24 (time t4).

Figure 7:
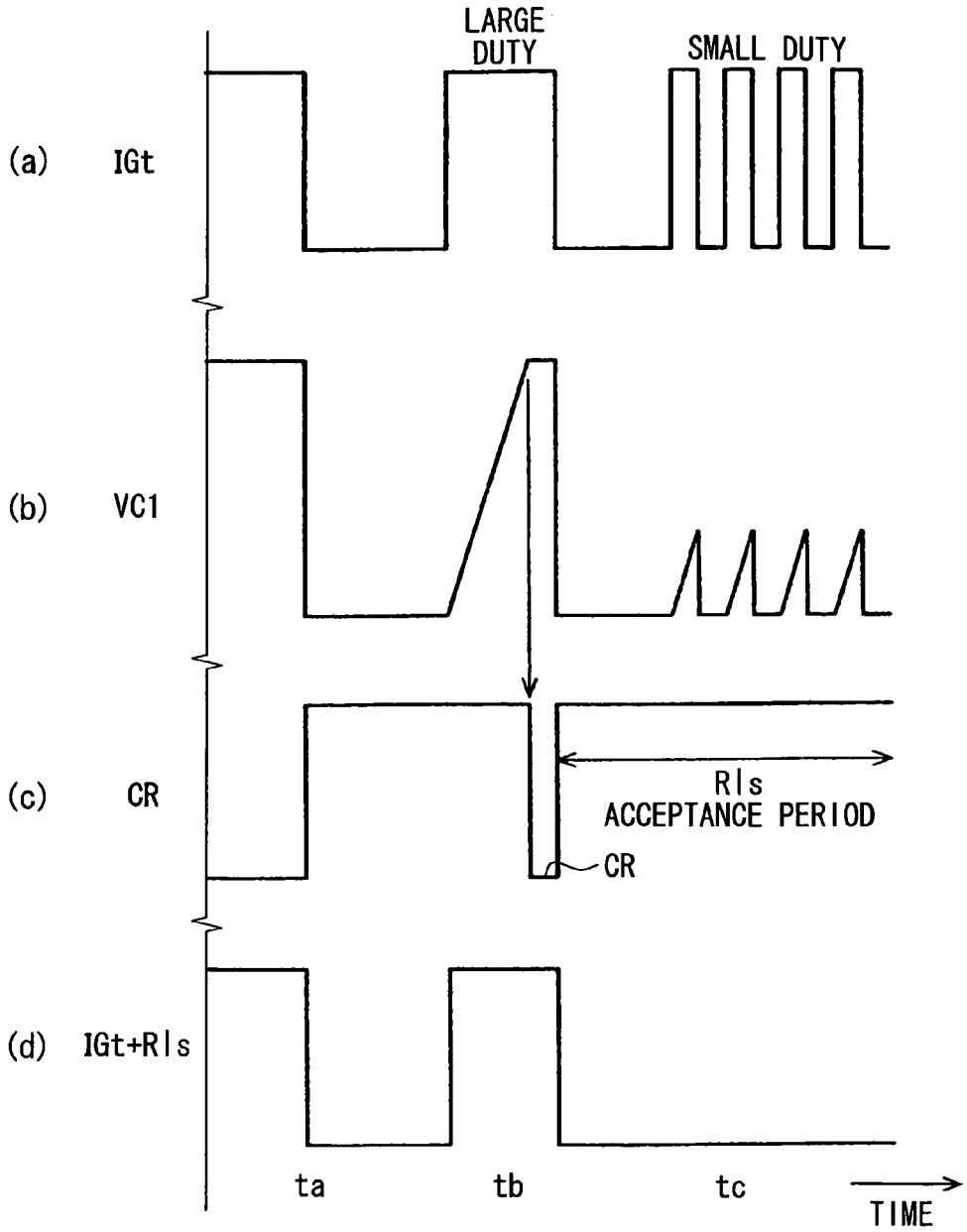
FIG. 7 is a time chart schematically showing signals related to the release signal check circuit in the first embodiment.

The release signal Rls is accepted (time period tc in FIG. 7). It is assumed that the input circuit 9 receives the signal IGt shown by (a) in FIG. 7. The terminal voltage VC1 of the capacitor C1 (FIG. 4) gradually increases as shown by (b) in FIG. 7 in proportion to the length of the signal In inputted from the input circuit 9. If the duty of the signal IGt is larger than a predetermined duty, the terminal voltage VC1 reaches a predetermined limit voltage and saturates. When the terminal voltage VC1 reaches the limit voltage, a counter reset signal CR is generated (time tb), so that the count of the flip-flops DFF1 to DFF3 is reset (time tb).

If the duty of the signal IGt is smaller than the predetermined duty, the terminal voltage VC1 does not reach the predetermined limit voltage and hence no counter reset signal CR is generated. As a result, the outputs of the flip-flops DFF1 to DFF3 gradually shift in response to the pulse signal applied from the input circuit 9. When the number of the pulse signals from the input circuit 9 reaches a predetermined number, all the outputs of the flip-flops DFF1 to DFF3 become H-level. Thus, the AND circuit 23*c* produces the release signal Rls of H-level.

When the release signal Rls is applied from the release signal check circuit 23, the lock circuit 24 outputs the lock release signal to the shut-off circuit 12*b* of the drive circuit 12 (time t14 in FIG. 6). When the lock circuit 24 applies the lock release signal to the shut-off circuit 12*b* of the drive circuit 12, the output of the drive main circuit 12*a* is validated and the drive signal is applied to the gate of the IGBT 13. As a result, even if no power-off command signal (+B power-off signal) is applied to the OR gate 16 of the igniter 2 from outside the igniter 2, the drive main circuit 12*a* drives the IGBT 13 to operate normally (time t15).

According to the first embodiment, when the plurality of pulse signals is applied as the release signal from the ECU 5, the latch circuit 15 stops applying the shut-off signal to the shut-off circuit 12*b* and releases the lock condition. As a result, the drive main circuit 12*a* can energize the IGBT 13 again (time t5 in FIG. 6). The condition detection circuit 10 can output to the ECU 5 the condition signal IGc corresponding to the energization current while the energization current I1 is being supplied to the IGBT 13 as understood from FIG. 5. The condition detection circuit 10 can thus informs the ECU 5 of the restoration of the igniter 2 to the normal operation. As described above, the igniter 2 can be released from the lock condition automatically from the outside and the normal operation can be restored without shutting off the power supply.

The current supply to the IGBT 13 by the drive main circuit 12*a* is shut off by the shut-off circuit 12*b*, when the temperature detection circuit 14 detects that the temperature of the IGBT 13 is higher than the predetermined temperature. Thus, the IGBT 13 can be protected from the over-supply of energization current.

Second Embodiment

Figure 8:
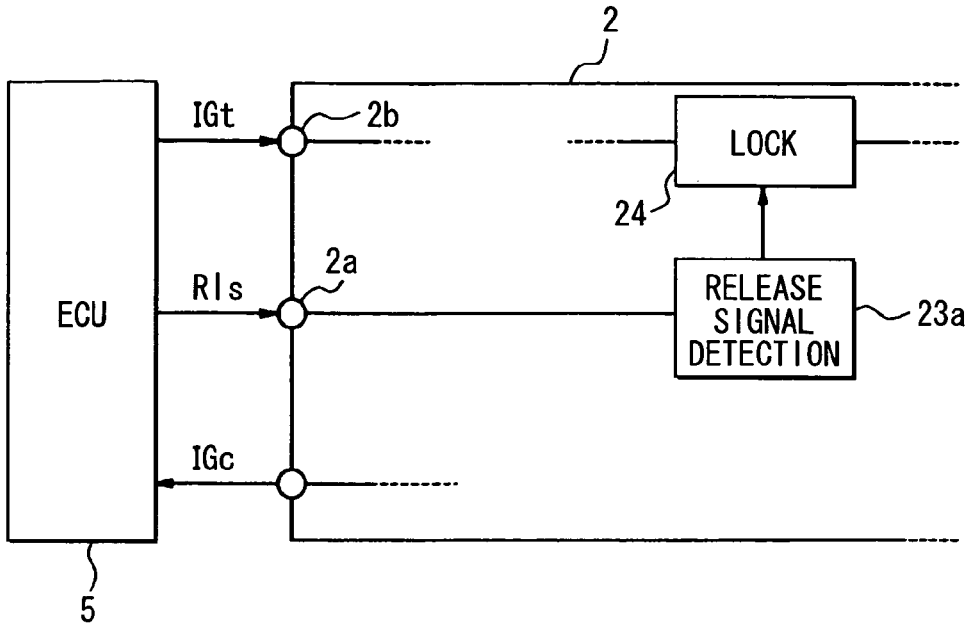
FIG. 8 is a block diagram partially showing a second embodiment of the present invention.
Figure 9:
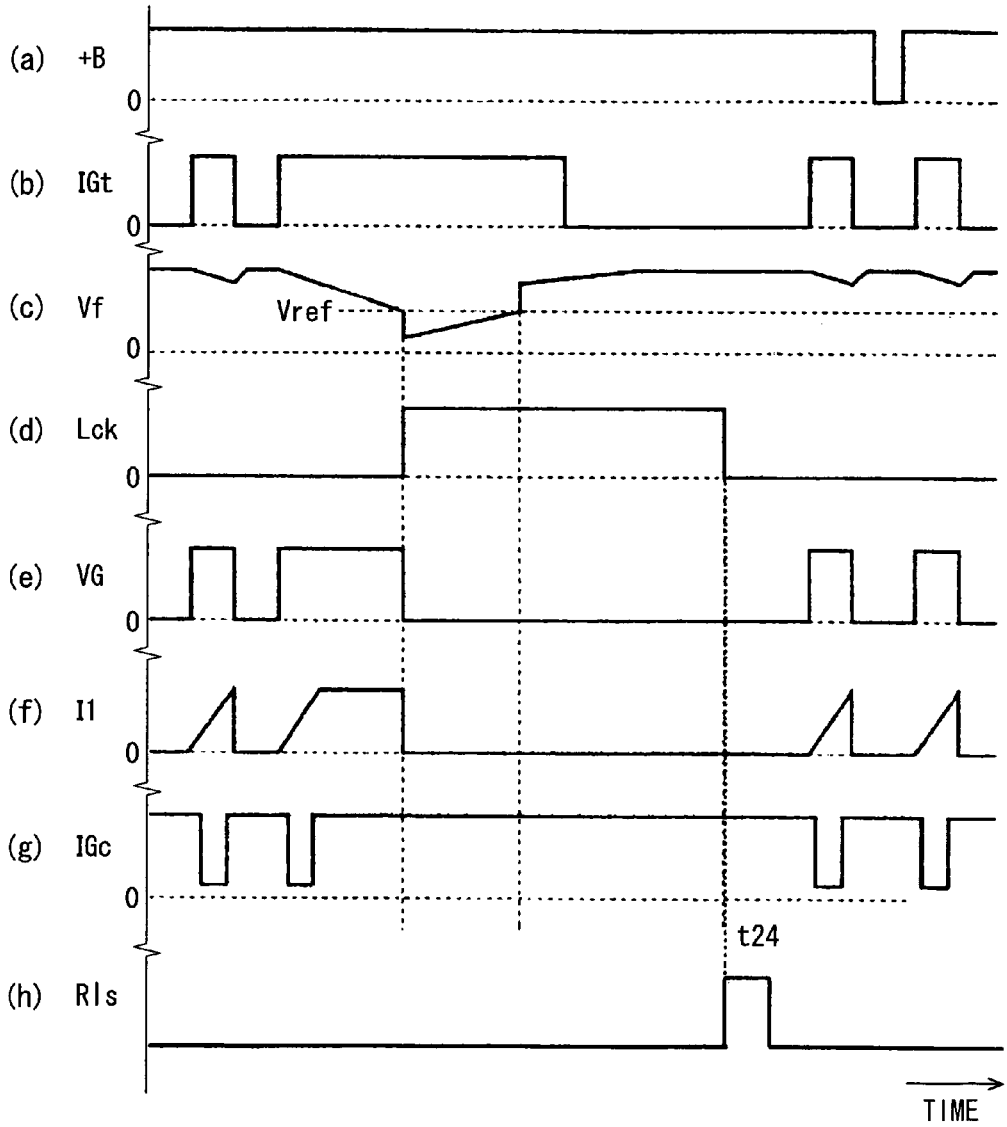
FIG. 9 is a time chart showing changes of various signals in the second embodiment.

The second embodiment of the present invention is shown in FIGS. 8 and 9. In the second embodiment, a release signal detection section 23*a* is configured to detect a release signal Rls through a release signal detection terminal 2*a* as opposed to the first embodiment, in which the release signal check circuit 23 detects the plurality of pulse signals superimposed on the ignition signal IGt as the release signal.

The same parts as in the first embodiment are denoted by the same reference numerals to simplify description. The different parts are described below.

As shown in FIG. 8, the ECU 5 produces the release signal Rls to the igniter 2 through the release signal detection terminal 2*a* and the igniter 2 receives the release signal Rls through the release signal detection terminal 2*a*. This release signal detection terminal 2*a* is provided separately from a terminal 2*b*, through which the ignition signal IGt is applied to the input circuit 9. The igniter 2 is provided with the release signal detection circuit (release signal detection section) 23*a* to detect the release signal Rls in place of the release signal check circuit 23.

As shown in FIG. 9, the release signal detection circuit 23*a* applies the release signal Rls to the lock circuit 24 so that the lock circuit 24 releases the lock condition (time t24 in FIG. 9 corresponding to t14 in FIG. 6), when the release signal detection circuit 23*a* detects a rise of a single pulse signal through the release signal detection terminal 2*a*.

The second embodiment provides the similar operation and advantage as that of the first embodiment. Since the release signal detection circuit 23*a* is only required to detect the rise of the single pulse signal, it is not necessary to detect the release signal by separately providing a circuit like the release signal check circuit 23 of the first embodiment, which checks the release signal Rls. As a result, the circuit configuration of the release signal detection circuit 23*a* is simplified.

Third Embodiment

The third embodiment of the present invention is shown in FIGS. 10 to 14. The third embodiment is different from the foregoing embodiments in that a timer is used to release the lock condition after a predetermined time interval from the lock condition. The same parts as in the foregoing embodiments are denoted by the same reference numerals to simplify the description. The different parts are described below.

Figure 10:
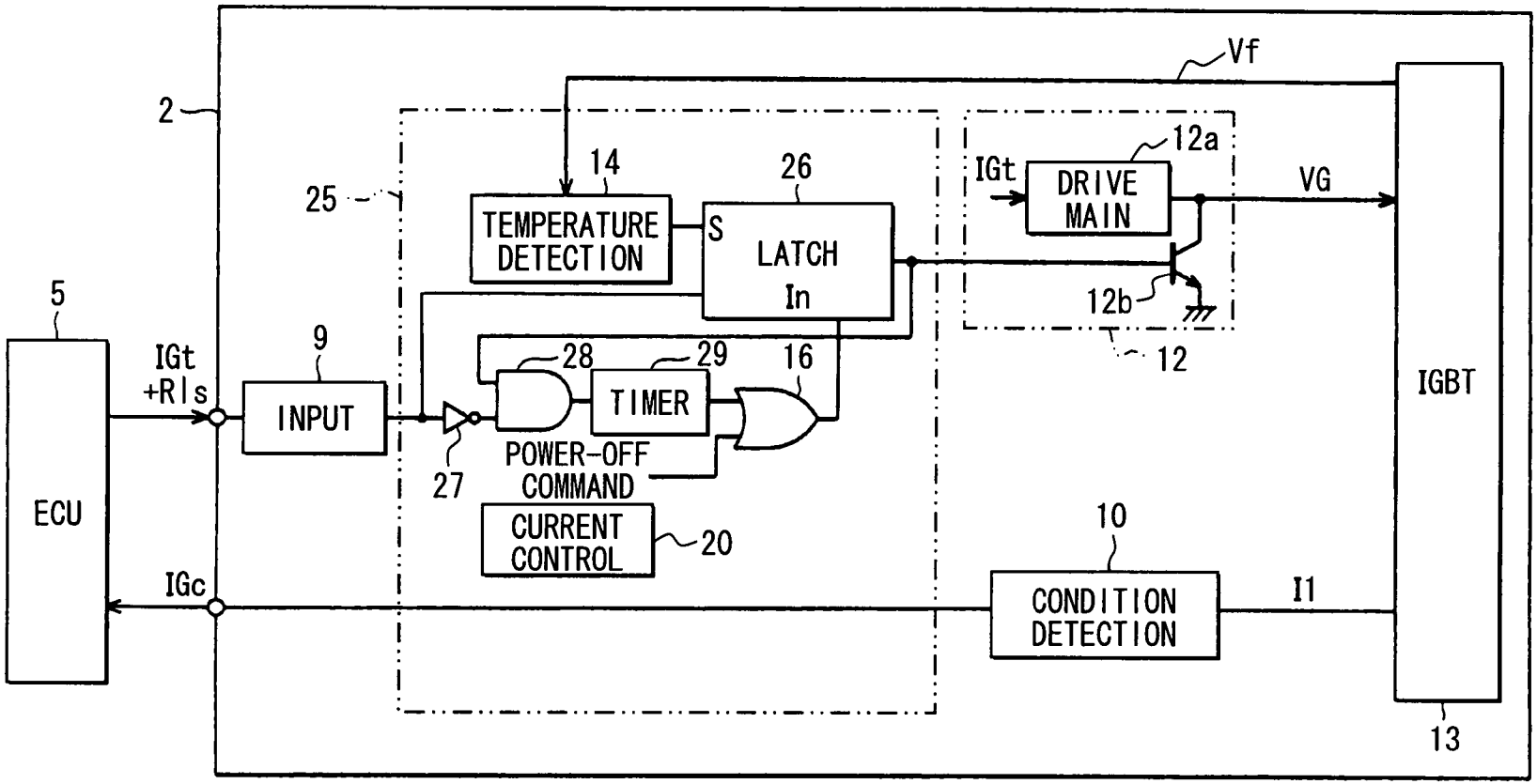
FIG. 10 is a block diagram showing a third embodiment of the present invention.

The igniter 2 is configured as shown in a block diagram form in FIG. 10 in place of that shown in FIG. 1. As shown in FIG. 10, a lock inhibition circuit 25 is provided in place of the lock inhibition circuit 8. It includes a latch circuit 26, a NOT gate 27, an AND gate 28, a timer circuit 29 in addition to the temperature detection circuit 14 and the OR gate 16 in the foregoing embodiments.

The output of the input circuit 9 is inputted to the latch circuit 26 and the NOT gate 27. The output of the NOT gate 27 is inputted to the AND gate 28. The output of the latch circuit 26 is inputted to the AND gate 28. The output of the AND gate 29 is inputted to the timer circuit 29. The output of the timer circuit 29 is inputted to the OR gate 16. The OR gate 16 is connected to the input terminal In of the latch circuit 26.

Figure 11:
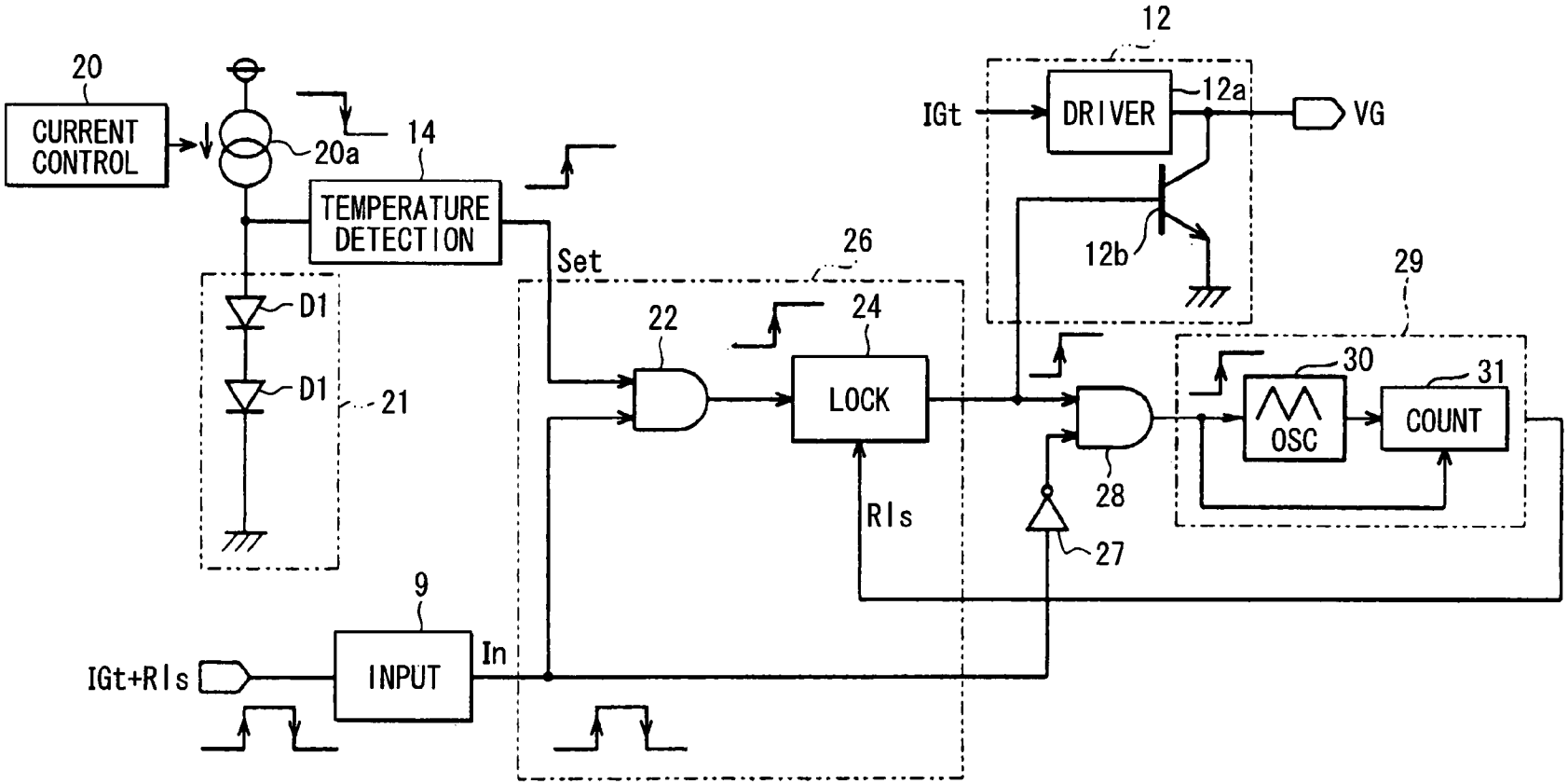
FIG. 11 is a circuit diagram showing a lock inhibition circuit and its peripheral circuits in the third embodiment.

The latch circuit 26 and the timer circuit 29 are shown in detail in FIG. 11. As shown in FIG. 11, the latch circuit 26 is configured with the AND gate 22 and the lock circuit 24 as in the foregoing embodiments. The AND gate 22 is configured to receive the outputs of the temperature detection circuit 14 and the input circuit 9.

The output of the AND gate 22 is applied to the lock circuit 24. The output of the lock circuit 24 is the output of the latch circuit 26 and applied to an AND gate 28 and the shut-off circuit 12*b* of the drive circuit 12.

The output of the AND gate 28 is inputted to the timer circuit 29. The timer circuit 29 is configured with an oscillation circuit 30 and a count circuit 31. The timer circuit 29 starts to operate in response to the output of the AND gate 28 as a reset signal and counts falls of an oscillation signal of the oscillation circuit 30 by the count circuit 31. Thus the timer circuit 29 performs a timer function for measuring a predetermined time interval T.

The predetermined time interval T is set as follows. If the lock condition is caused by an abnormality signal generated temporarily at the time of engine starting, the ignition signal IGt of H-level is changed to L-level by an energization guard function of the ECU 5 after a predetermined time interval. Then the engine is started again by a driver after recognizing previous failure in starting the engine. The minimum time interval from the change of the ignition signal IGt to the L-level to the input of the ignition signal IGt of H-level for restarting is set to 500 (milliseconds). Therefore, it is necessary to release the lock condition within this time interval so that the ignition device 2 operates normally when the ignition signal IGt becomes H-level next time.

It is necessary not to release the lock condition within 200 (milliseconds), because the circuit need be protected by the lock inhibition function when the input signal is abnormal (large duty) under a condition that the engine rotation speed is more than the idle rotation speed, 600 (rpm). In consideration of the circuit protection under lower rotation speeds, the predetermined time interval is preferably set to a longer period as much as possible. The large duty (long current supply period) indicates that the duty of the input signal is greater than the normal energization and exceeds a limit, which will cause impermissible over-heating of the IGBT 13.

For those reasons it is necessary to set the predetermined time interval T between 200 to 500 (milliseconds), for example. The predetermined time interval T is set to 400 (milliseconds) in consideration of margin in this embodiment. The output of the count circuit 31 is inputted into the lock circuit 24 as the release signal Rls.

Figure 12:
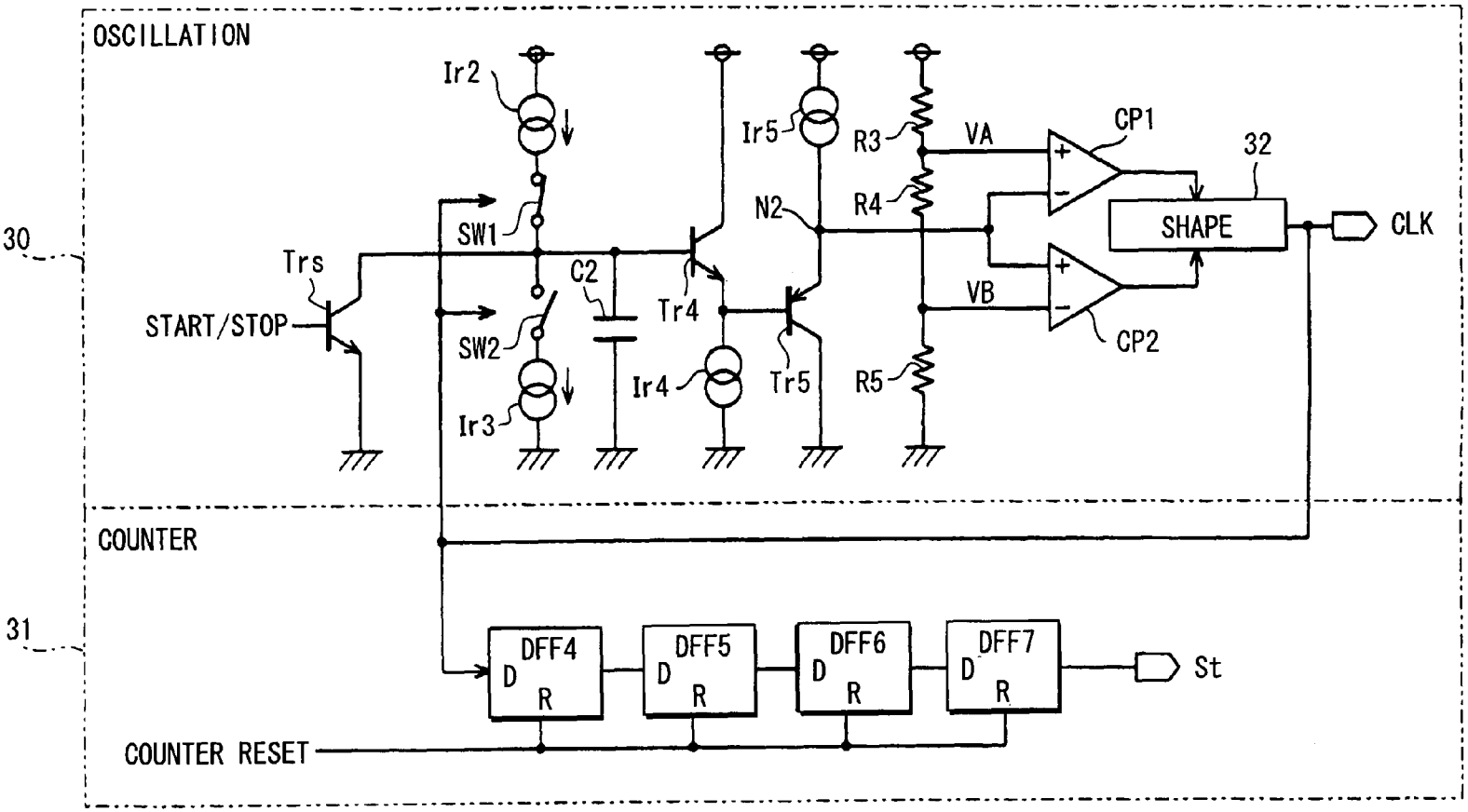
FIG. 12 is a circuit diagram showing an oscillation circuit and a count circuit in the third embodiment.

The oscillation circuit and the count circuit are configured in detail as shown in FIG. 12. As shown in FIG. 12, the oscillation circuit 30 includes current sources Ir1 to Ir5, a capacitor C2, switches SW1, SW2, resistors R3 to R5, a NPN transistor Tr4. a PNP transistor Tr6, a comparator CP1, Cp1 and a waveform shape circuit 32.

As shown in FIG. 12, the current source Ir1, the switches SW1, SW2 and the current source Ir3 are connected in series between the power source and the ground. The capacitor C2 is connected to the output terminal of the current source Ir2 and the input terminal of the current source Ir3. The capacitor C2 is charged and discharged in accordance with switching of the switches SW1 and SW2. The base of the transistor Tr4 is connected to the charge/discharge terminal of the capacitor C2, to which a transistor Trs is also connected. This transistor Trs is configured to start and stop the operation of the oscillation circuit 30 in response to a start signal and a stop signal applied to its control terminal, respectively.

The collector of the transistor Tr4 is connected to the power source and the emitter of the same is connected to the ground through the current source Ir4. The common junction between the transistor Tr4 and the emitter and the current source Ir4 is connected to the base of the transistor Tr5. The current source Ir5 supplies a current to the emitter of the transistor Tr5. The collector of the transistor Tr5 is connected to the ground.

The resistors R3 to R5 are connected in series between the power source and the ground. The two common junctions among the resistors R3 to R5 are connected to the non-inverting input terminal (reference voltage input terminal) of the comparator CP1 and the inverting-input terminal (reference voltage input terminal) of the comparator CP2, respectively.

A common junction N2 of the current source Ir5 and the transistor Tr5 is connected to the inverting input terminal of the comparator CP1 and the non-inverting input terminal of the comparator CP2. The outputs of the comparators CP1 and CP2 are applied to the waveform shape circuit 32. The waveform shape circuit 32 is configured to perform waveform shaping in accordance with the output signals of the comparators CP1 and CP2 and output the waveform-shaped rectangular signal from a clock terminal CLK.

The clock terminal CLK is connected to the input of the count circuit 31 and control terminals of the switches SW1, SW2 of the oscillation circuit 30. Thus, the switches SW1 and SW2 are switchable. The count circuit 31 is configured with a plurality of D-type flip-flops DFF4 to DFF7 connected in cascade so that the D-type flip-flop DFF7 produces a signal indicative of an elapse of timer time T.

The operation of the oscillation circuit 30 and the count circuit 31 are shown schematically in FIG. 13. As shown in FIG. 13, when the switch SW1 is turned on and the switch SW2 is turned off, current flows from the current source Ir1 to the capacitor C2 and the terminal voltage VC2 of the capacitor C2 increases. When the switch SW1 is turned off and the switch SW2 is turned on, on the other hand, the current source Ir3 draws current from the capacitor C2 to discharge the capacitor C2 and the terminal voltage VC2 of the capacitor C2 decreases.

The voltage developed at the common junction N2 between the inverting input terminal of the comparator CP1 and the non-inverting input terminal of the comparator CP2 becomes equal to VC2 (charge voltage of capacitor C2)−Vbe (base-emitter voltage of the transistor Tr4)+Vbe (base-emitter voltage of transistor Tr5). If the base-emitter voltages Vbe of the transistors Tr4 and Tr5 are equal to each other, the voltage at the common junction N2 becomes equal to the charge voltage VC2 of the capacitor C2.

When a stop signal of H-level is applied to the control terminal of the transistor Trs, the transistor Trs is turned on and the capacitor C2 is not charged nor discharged. The terminal voltage VC2 of the capacitor C2 is 0 (volt). In this instance, the output of the comparator CP1 is at H-level and the output of the comparator CP2 is at L-level. The waveform shape circuit 32 maintains the switch SW1 turned on and the switch SW2 turned off.

When the start signal of L-level of the oscillation circuit 30 is applied to the control terminal of the transistor Trs, the capacitor C2 starts to be charged and the its terminal voltage VC2 increases. The comparators CP1 and CP2 compare the voltage VC2 developed at the common junction N2 with predetermined reference voltages VA and VB, respectively. When the terminal voltage VC2 of the capacitor C2 reaches the reference voltage VB, the voltage at the common junction N2 also reaches the reference voltage VB. Thus, the output of the comparator CP1 becomes H-level and the output of the comparator CP2 becomes L-level. Although the waveform shape circuit 32 receives changes in the output signals of the comparators CP1 and CP2, it maintains the switch SW1 turned on and the switch SW2 turned off.

When the capacitor C2 continues to be charged, the terminal voltage VC2 of the capacitor C2 reaches the reference voltage VA and the voltage at the common junction N2 also reaches the reference voltage VA. The output of the comparator CP1 becomes L-level and the output of the comparator CP2 becomes H-level. At this moment, the waveform shape circuit 32 switches the clock signal from L-level to H-level (t36 in FIG. 13) thereby to change the switch SW1 to turned-off and the switch SW2 to turned-on. When the switch SW1 is turned off and the switch SW2 is turned on, the charge of the capacitor C2 is discharged through the current source Ir3 and the terminal voltage of the capacitor C2 decreases.

When the terminal voltage VC2 of the capacitor C2 falls to be lower than the reference voltage VA, both of the outputs of the comparator CP1 and the comparator CP2 become H-level. The waveform shape circuit 32 continues to output H-level as the clock signal CLK thereby to maintain the switch SW1 turned off and the switch SW2 turned on.

When the capacitor C2 is discharged further and its terminal voltage VC2 becomes lower than the reference voltage VB, the output of the comparator CP1 remains at H-level but the output of the comparators CP2 changes to L-level. The waveform shape circuit outputs the L-level to the clock terminal CLK in response to the output change of the comparator CP2 (time t37 in FIG. 13) and changes the switch SW1 to turned-on and the switch SW2 to turned-off. Thus, the above-described on/off condition change is repeated (times t38 and t39 in FIG. 13). That is, the waveform shape circuit 32 outputs the clock signal CLK by performing the waveform shaping in accordance with the present and output conditions of the comparators CP1 and CP2.

The rectangular signal is outputted from the output terminal of the clock signal CLK as shown in FIG. 12. This output signal is also applied to the shift register of the D-type flip-flops DFF4 to DFF7. The count circuit 31 is configured to output a determination result indicating that the predetermined timer period T has elapsed by counting the predetermined number of pulse-shaped clock signals CLK. The counter is reset by a reset signal if the predetermined number of pulse-shaped clock signals are not inputted.

Figure 14:
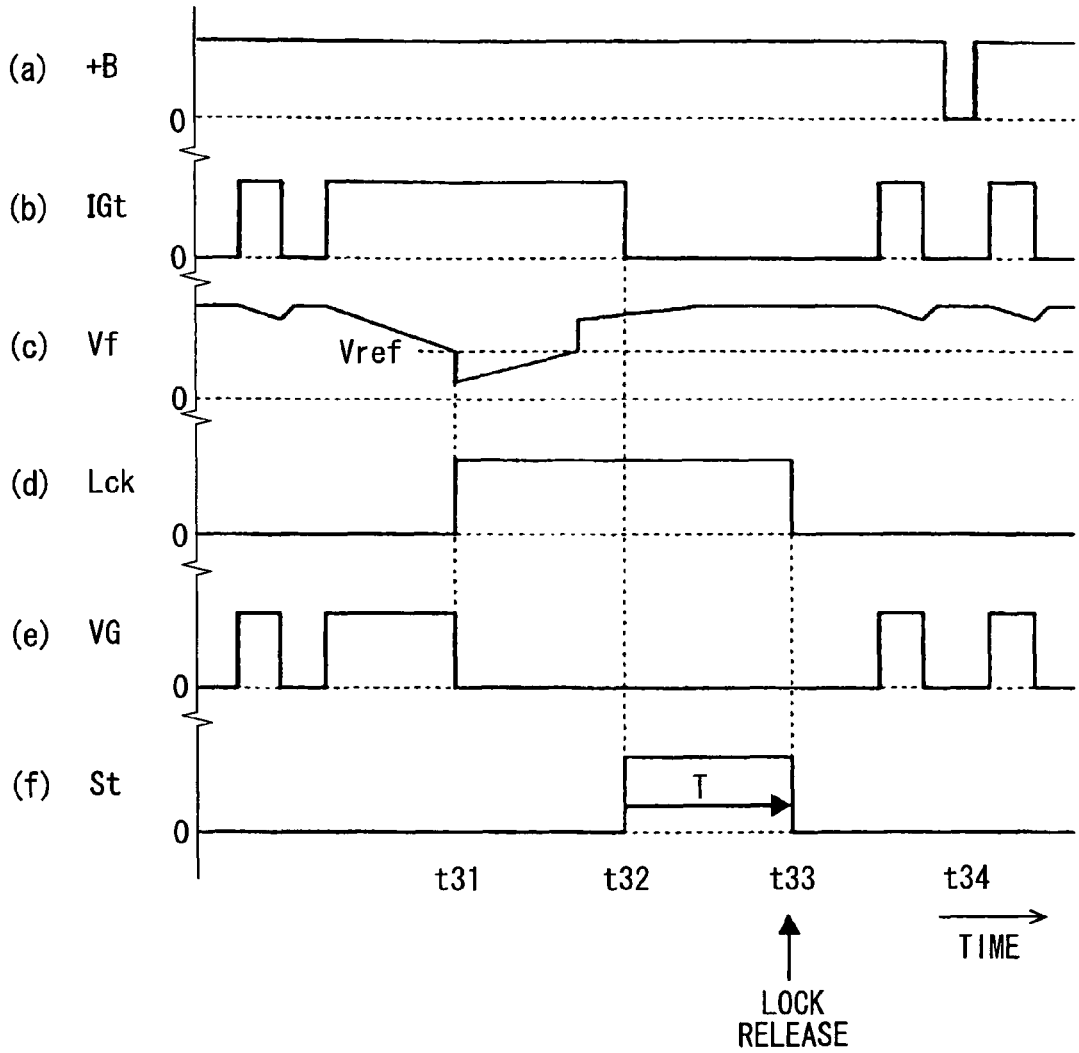
FIG. 14 is a time chart showing changes of various signals in the third embodiment.

The operation of the third embodiment shown in FIG. 11 is shown in a time chart of FIG. 14. As shown in FIG. 14, when the voltage Vf of the built-in diode D1 of the IGBT 13 falls to be lower than the over-temperature threshold level Vref, the lock circuit 24 outputs the lock signal Lck of H-level (time t31 in FIG. 14).

If the ignition signal IGt remains at H-level even after the lock signal Lck has been outputted from the lock circuit 24, the timer circuit 20 does not operate. However, when the ignition signal IGt changes to L-level, the output of the NOT gate 27 becomes H-level and hence the output of the AND gate 28 also becomes H-level. The timer circuit 29 starts to operate (time t32 in FIG. 14).

When the predetermined time interval T elapses after the timer circuit 29 started its count operation, the timer circuit 29 outputs a timer output signal St of L-level as the release signal Rls (time t33 in FIG. 14). The lock circuit 24 outputs L-level so that no shut-off signal is applied to the shut-off circuit 12*b*. As a result, the gate signal applied from the drive main circuit 12*a* to the IGBT 13 is validated (time t34 in FIG. 14).

According to the third embodiment, the timer circuit 29 measures the predetermined time interval T after the shut-off circuit 12*b* stops the gate driving operation of the drive main circuit 12*a*, and releases the shut-off circuit 12*b* from shutting off the energization when the predetermined time interval T has measured. Then the drive main circuit 12*a* is enabled to restart the current supply to the IGBT 13. Therefore, the condition detection circuit 10 restores its normal operation by outputting the condition signal IGc to the ECU 5 when the IGBT 13 is turned on and send back information indicating restoration of the normal operation. Thus, the normal operation can be restored without turning off the power supply.

Fourth Embodiment

Figure 15:
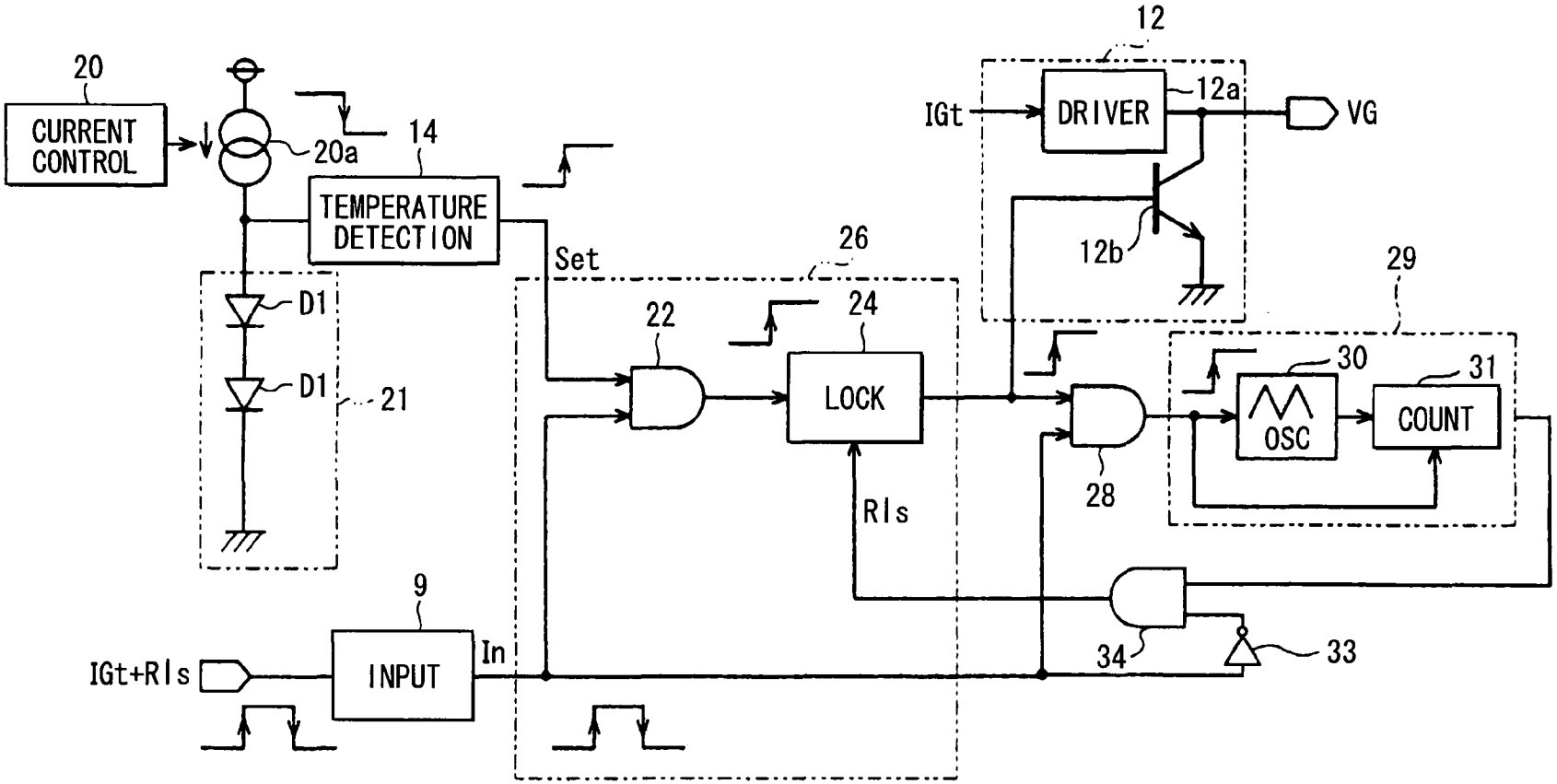
FIG. 15 is a circuit diagram showing a lock inhibition circuit and its peripheral circuits in a fourth embodiment.
Figure 16:
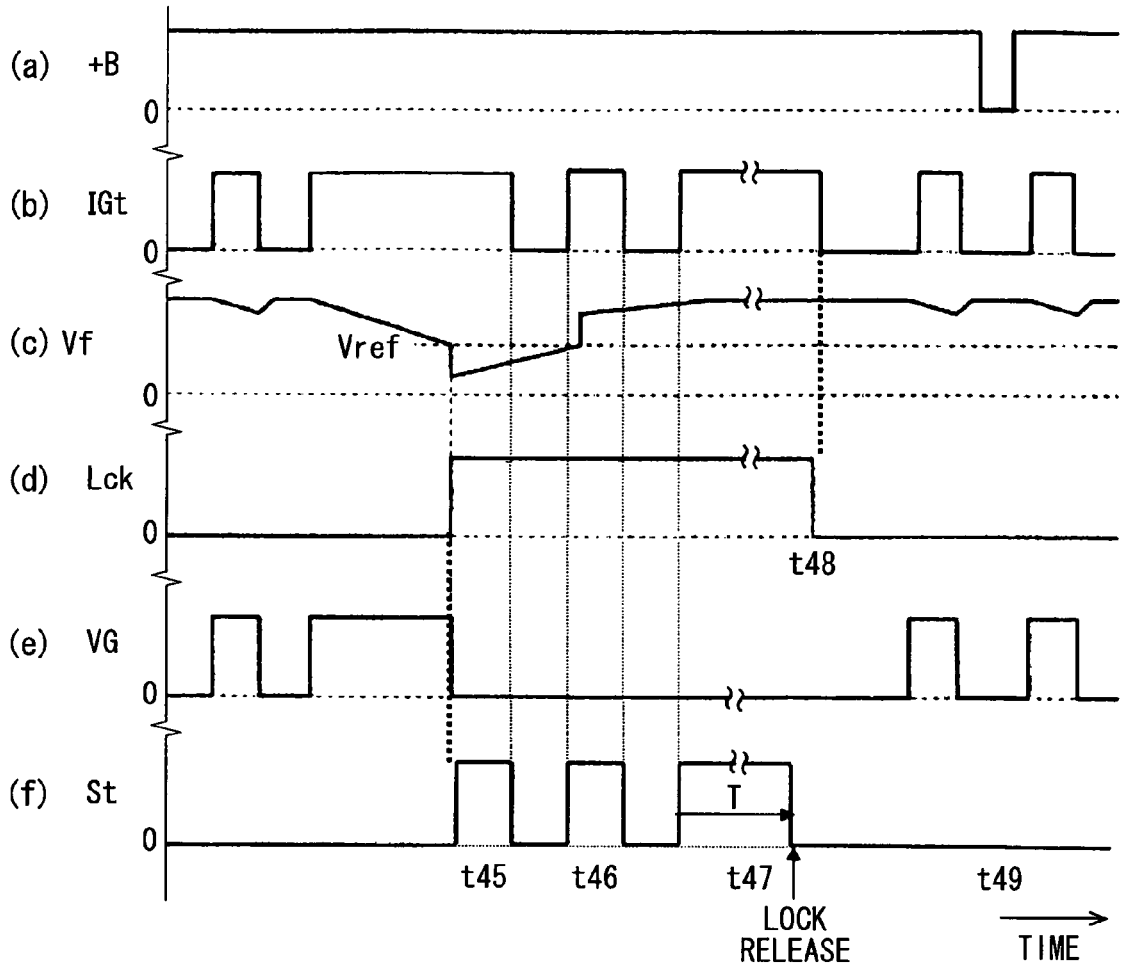
FIG. 16 is a time chart showing changes of various signals in the fourth embodiment.
Figure 17:
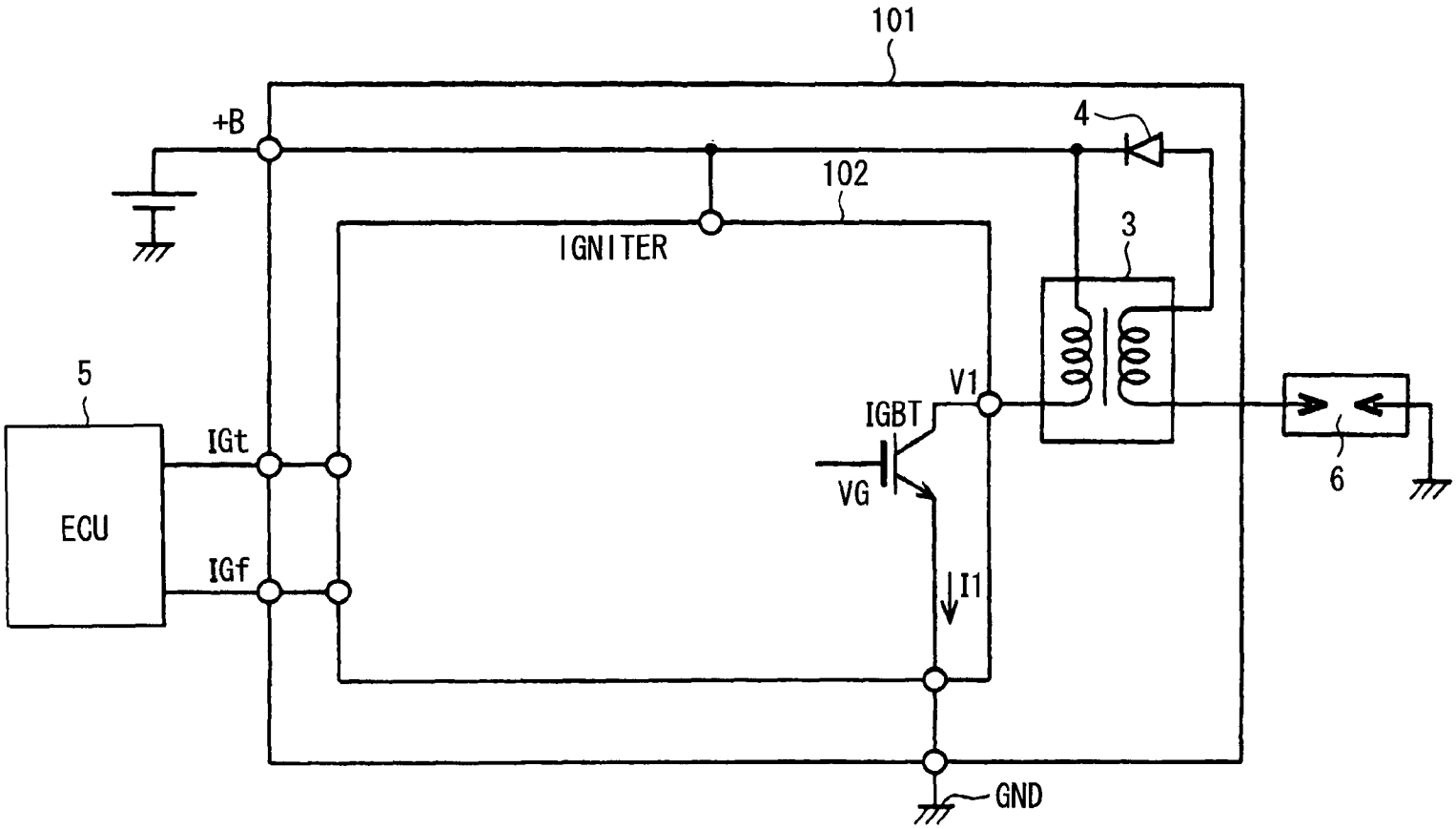
FIG. 17 PRIOR ART
FIG. 17 is a block diagram showing a conventional ignition device for an internal combustion engine.
Figure 18A:
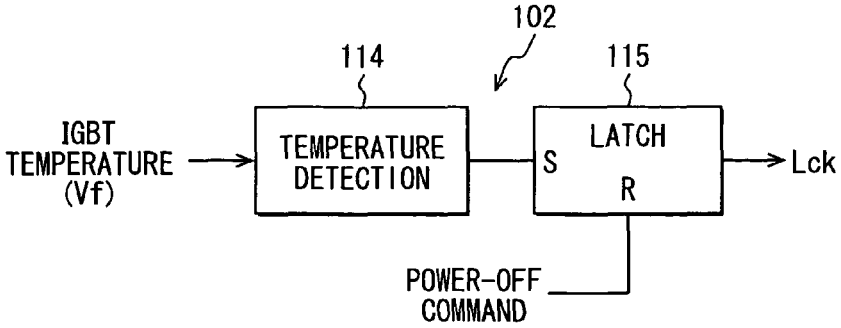
FIG. 18A PRIOR ART
FIG. 18A is a circuit diagram showing a lock inhibition circuit of the conventional ignition device.
Figure 18B:
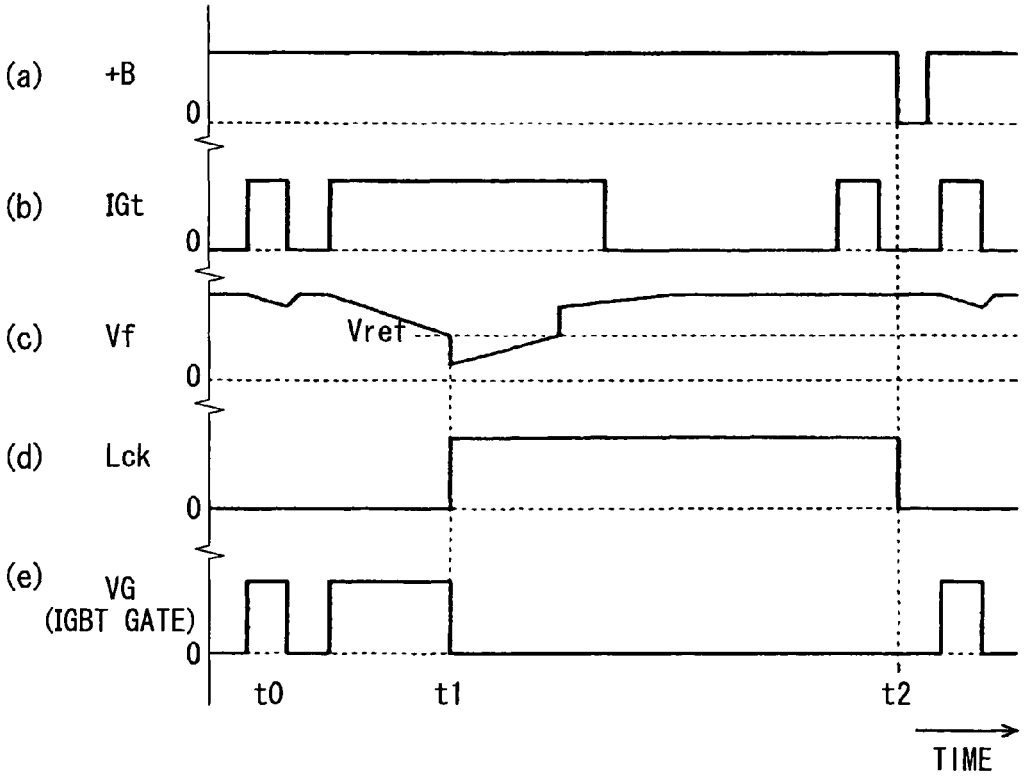
FIG. 18B PRIOR ART
FIG. 18B is a time chart showing changes of various signals in the conventional ignition device.

The fourth embodiment of the present invention is shown in FIGS. 15 and 16. This embodiment is different from the foregoing embodiments in that a release section is configured to release the shut-off condition caused by the shut-off section, after the timer section completes measurement of the predetermined time interval and the ignition signal IGt disappears.

In this embodiment, a NOT gate 33 and an AND gate 34 are provided in place of the NOT gate 27, which is provided between the input circuit 9 and the AND gate 28 in the third embodiment.

The output of the input circuit 9 is inputted to the NOT gate 33 and the output of the NOT gate 33 is inputted to the AND gate 34. The output of the timer circuit 29 is also inputted to the AND gate 34. The AND gate 34 outputs, as the release signal, a logical product (AND) of the outputs of the NOT gate 33 and the timer circuit 29 to the lock circuit 24.

The operation of the fourth embodiment is shown in the time chart of FIG. 16. As shown in FIG. 16, the timer circuit 29 starts its time measurement operation after the lock circuit 24 outputs the lock signal Lck. While the ignition signal IGt is at H-level, the timer circuit 29 continues its time measurement operation. However, when the ignition signal IGt changes to L-level, the AND gate 28 outputs L-level. As a result, the timer circuit 29 is reset and stops its time measurement operation before the predetermined time T elapses.

As described in the third embodiment, since the time interval of H-level is set to be shorter than the predetermined time interval T when the duty of the ignition signal IGt is the large duty, the lock condition is maintained.

That is, if the ignition signal IGt changes to L-level before the timer circuit 29 measures the predetermined time interval T, the timer circuit 29 stops time measurement operation and the output St of the timer circuit 29 is reset (time t45, t46 in FIG. 16).

For example, when the ignition signal IGt is abnormally fixed to H-level temporarily, the lock release function is validated when the timer circuit 29 completes measurement of the predetermined time interval T (time t47 in FIG. 16). If the ignition signal IGt is at H-level, the NOT gate 33 outputs L-level even when the timer circuit 29 measures the predetermined time interval T. The AND gate 34 responsively outputs L-level and the release signal Rls is not applied to the lock circuit 24.

When the ignition signal IGt changes to L-level, the output of the NOT gate 33 is reversed and the H-level signal is inputted to the AND gate 34. Since the timer circuit 29 continues to output the signal of H-level as the release signal, the lock circuit 24 receives the release signal of H-level and releases the lock condition (time t48 in FIG. 16). Then the gate voltage VG is outputted to the gate of the IGBT 13 (time interval t49 in FIG. 16).

According to the fourth embodiment, the lock circuit 24 releases the lock condition after the timer circuit 29 completes the measurement of the predetermined interval T and the ignition signal IGt disappears. Therefore, similar advantages are provided as in the foregoing embodiments.

Other Embodiments

The present invention is not limited to the disclosed embodiments but may be modified as follows.

The switching element is not limited to the IGBT 13. Although the energization current I1 supplied to the IGBT 13 is detected in the normal condition by the condition detection circuit 10 and the ignition condition signal corresponding to the detected current is outputted to the ECU 5 in the foregoing embodiments, the embodiments may be modified such that the condition signal is supplied to the ECU 5 only when any abnormality such as over-temperature is detected.

What is claimed is:

1. An ignition device for an internal combustion engine having an ignition coil controlled by an electronic control unit, the ignition device comprising:

a switching element connected to the ignition coil;

a drive section configured to turn on and of current supply to the ignition coil by turning on and off the switching element in response to an ignition signal supplied from the electronic control unit;

a temperature detection section configured to detect temperature of the switching element;

a shut-off section configured to shut off the current supply to the switching element when the temperature detected by the temperature detection section rises to be higher than a predetermined temperature;

a timer section configured to measure a predetermined time interval after the current supply is shut off by the shut-off section; and a release section configured to release a current supply shut-off condition of the switching element in response to completion of measurement of the predetermined time interval by the timer section.

2. The ignition device for an internal combustion engine according to claim 1, wherein the timer section is configured to start the measurement of the predetermined time interval after shut-off of the current supply by the shut-off section and from a time of disappearance of the ignition signal.

3. The ignition device for an internal combustion engine according to claim 1, wherein the release section is configured to release the current supply shut-off condition of the switching element after completion of measurement of the predetermined time interval and disappearance of the ignition signal.

4. The ignition device for an internal combustion engine according to claim 1, wherein the temperature detection section determines that the temperature of the switching element is higher than a predetermined temperature by determining that a voltage of the switching element is lower than a predetermined reference voltage.

5. An ignition device for an internal combustion engine having an ignition coil controlled by an electronic control unit, the ignition device comprising:

a switching element connected to the ignition coil;

a drive section configured to turn on and off current supply to the ignition coil by turning on and off the switching element in response to an ignition signal supplied from the electronic control unit;

a temperature detection section configured to detect temperature of the switching element;

a shut-off section configured to shut off the current supply to the switching element when the temperature detected by the temperature detection section rises to be higher than a predetermined temperature; and a release section configured to release a current supply shut-off condition of the switching element in response to a release signal supplied from the electronic control unit.

6. The ignition device for an internal combustion engine according to claim 5, further comprising:

a release signal detection section having a release signal detection terminal, through which the release signal is received from the electronic control unit.

7. The ignition device for an internal combustion engine according to claim 5, wherein:

the release signal is superimposed on the ignition signal supplied from the electronic control unit; and the release section includes a release signal detection section, which detects whether the release signal is superimposed on the ignition signal, and releases the current supply shut-off condition of the switching element when the release signal is superimposed on the ignition signal.

8. The ignition device for an internal combustion engine according to claim 5, wherein the temperature detection section determines that the temperature of the switching element is higher than a predetermined temperature by determining that a voltage of the switching element is lower than a predetermined reference voltage.

* * * * *